US008507812B2

(12) United States Patent
No

(10) Patent No.: US 8,507,812 B2
(45) Date of Patent: Aug. 13, 2013

(54) SWITCH ASSEMBLY AND EARPHONE SET WITH THE SAME

(75) Inventor: Jin-Hong No, Seoul (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 1145 days.

(21) Appl. No.: 12/283,663

(22) Filed: Sep. 15, 2008

(65) Prior Publication Data

US 2009/0095605 A1 Apr. 16, 2009

(30) Foreign Application Priority Data

Oct. 16, 2007 (KR) ..... 10-2007-0104088

(51) Int. Cl.
*H01H 9/00* (2006.01)

(52) U.S. Cl.
USPC ..... 200/1 B; 200/11 R; 200/571; 200/336; 381/74; 381/384

(58) Field of Classification Search
USPC ..... 381/74, 123, 370–374, 384, 34; 200/1 B, 200/564–567, 570–572
See application file for complete search history.

(56) References Cited

U.S. PATENT DOCUMENTS 7,145,087 B1 * 12/2006 Su et al. ..... 200/4
7,550,687 B2 * 6/2009 Su ..... 200/11 R

* cited by examiner

*Primary Examiner* — Renee S Luebke
*Assistant Examiner* — Lheiren Mae Caroc

(57) ABSTRACT

A switch assembly and an earphone set having the same. The switch assembly includes a first plate in which a board is mounted, a second plate installed opposite the first plate, a connection member provided between the first and second plates so as to resiliently connect the first and second plates, a plurality of first contacts provided on a rear face thereof in order to selectively connect a circuit of the board, and a plurality of second contacts provided on a front face thereof in correspondence to the first contacts.

18 Claims, 14 Drawing Sheets

SWITCH ASSEMBLY AND EARPHONE SET WITH THE SAME

CROSS-REFERENCE TO RELATED APPLICATION(S) AND CLAIM OF PRIORITY

The present application makes reference to, incorporates the same herein, and claims all benefits accruing under 35 U.S.C. §119 from an application for "SWITCH ASSEMBLY AND EARPHONE SET WITH THE SAME" filed in the Korean Intellectual Property Office on Oct. 16, 2007 and there duly assigned Serial No. 2007-0104088.

TECHNICAL FIELD OF THE INVENTION

The present invention relates to a switch assembly and earphone set with the same and, more particularly, to a switch assembly, in which an operation mode and a volume mode are easily and conveniently selected and regulated, and an earphone set having the same.

BACKGROUND OF THE INVENTION

Generally, with the miniaturization of portable electronic appliances such as mobile phones, MP3, CD players and so forth, a rapid increase in the number of users and the diversity of users' ages resulted in a variety of products being sold and distributed. In such electronic products, a user often uses an earphone set, which is connected to a connector of the products by means of a jack thereof, so as to hear a high quality of sound while cutting off external noise transmitted from the outside.

FIG. 1 is a perspective view illustrating a conventional earphone set and a switch assembly.

As illustrated in FIG. 1, the earphone set 10 includes a connecting jack 12 at one end of a wire 11 thereof and speakers 13 at the other end of the wire.

The earphone set 10 is equipped with a switch assembly 20, which is connected to the middle of the wire 11. The switch assembly 20 has a selection button 21 for selecting many operation modes, and a control button 22 for regulating volume or so forth.

However, the conventional switch assembly has problems with its complicated structure, inconvenient manipulation and high cost of production because it has many buttons.

SUMMARY OF THE INVENTION

To address the above-discussed deficiencies of the prior art, it is a primary object to provide a switch assembly, in which operation modes, volume or so forth can be selected and controlled not by pushing a button, but by sliding a plate serving as a button, thereby making the entire structure very simple and providing smooth operation, and an earphone set having the same.

According to an aspect of the invention, there is provided a switch assembly for an earphone set, which includes: a first plate in which a board is mounted, a second plate provided opposite the first plate, a connection member provided between the first and second plates so as to resiliently connect the first and second plates, a plurality of first contacts provided on a rear face thereof in order to selectively connect a circuit of the board, and a plurality of second contacts provided on a front face thereof corresponding to the first contacts.

The second plate may be slidable in radial and circumferential directions with respect to the connection member.

The first and second plates may be of circular, planar shape.

The first plate may include at least one restricting configuration on the rear face thereof in a circumferential direction, and the second plate may include at least one engaging protrusion corresponding to the restricting configuration on the front face thereof.

The connection member may be disposed at the center of the first and second plates.

The connection member may be disposed along outer circumferences of the first and second plates.

The connection member may be made of a flexible, resilient material such as rubber, and include ball joint parts at opposite ends thereof.

According to another aspect of the invention, there is provided an earphone set, which includes: speakers provided on one end of a wire, a connection jack provided on the other end of the wire, and a switch assembly having a first plate with a plurality of first contacts and a second plate with a plurality of second contacts, the first plate being installed between both ends of the wire, the second plate being installed opposite the first plate by means of a connection member so as to be slidable in radial and circumferential directions with respect to the connection member.

The first contacts may come into contact with the second contacts when the first plate slides in radial and circumferential directions.

The first plate may include at least one restricting configuration on a rear face thereof in a circumferential direction, and the second plate may include at least one engaging protrusion corresponding to the restricting configuration on a front face thereof.

The connection member may be disposed at the center of the first and second plates, and include ball joint parts at opposite ends thereof.

As set forth above, according to the present invention, operation modes, volume or so on can be selected and controlled not by pushing a button, but by sliding a plate serving as a button, thereby making the entire structure very simple and providing smooth operation.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 2 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged earphone set.

Figure 1:
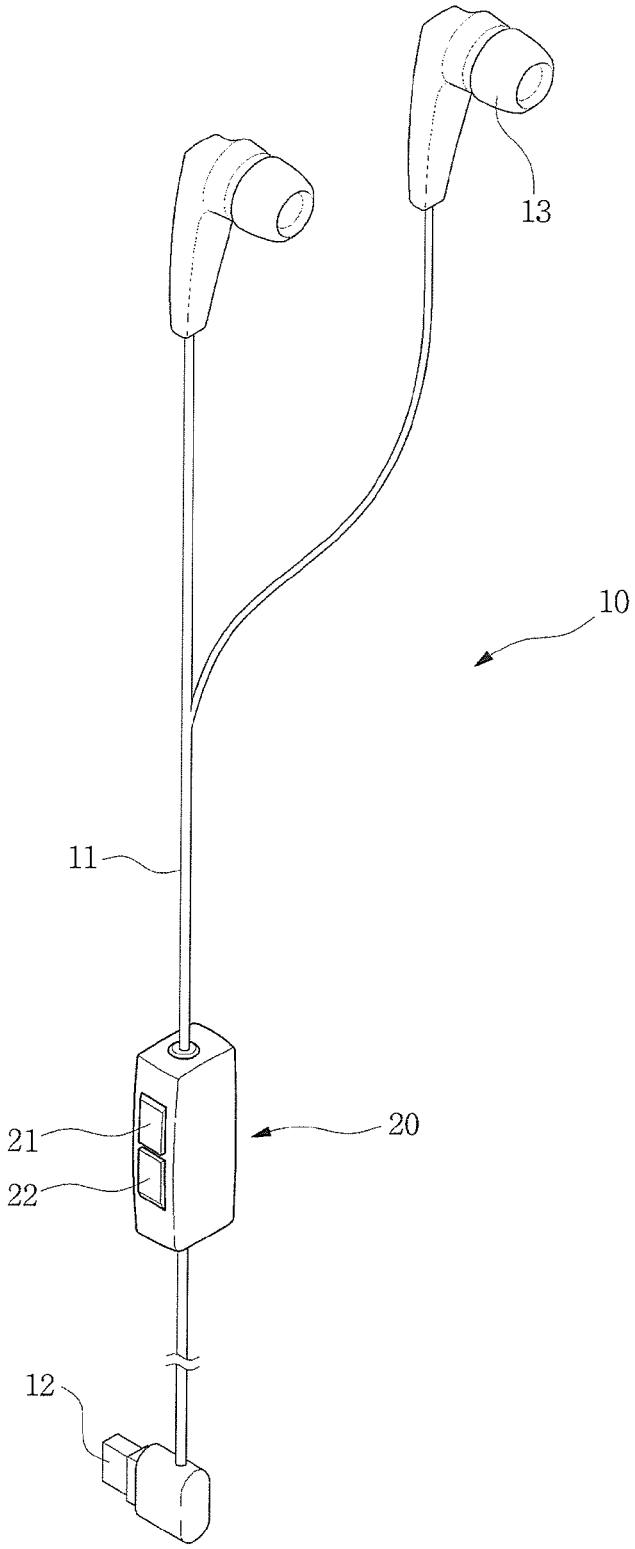
FIG. 1 (PRIOR ART)
FIG. 1 is a perspective view illustrating an earphone set and a switch assembly thereof of the prior art.
Figure 2:
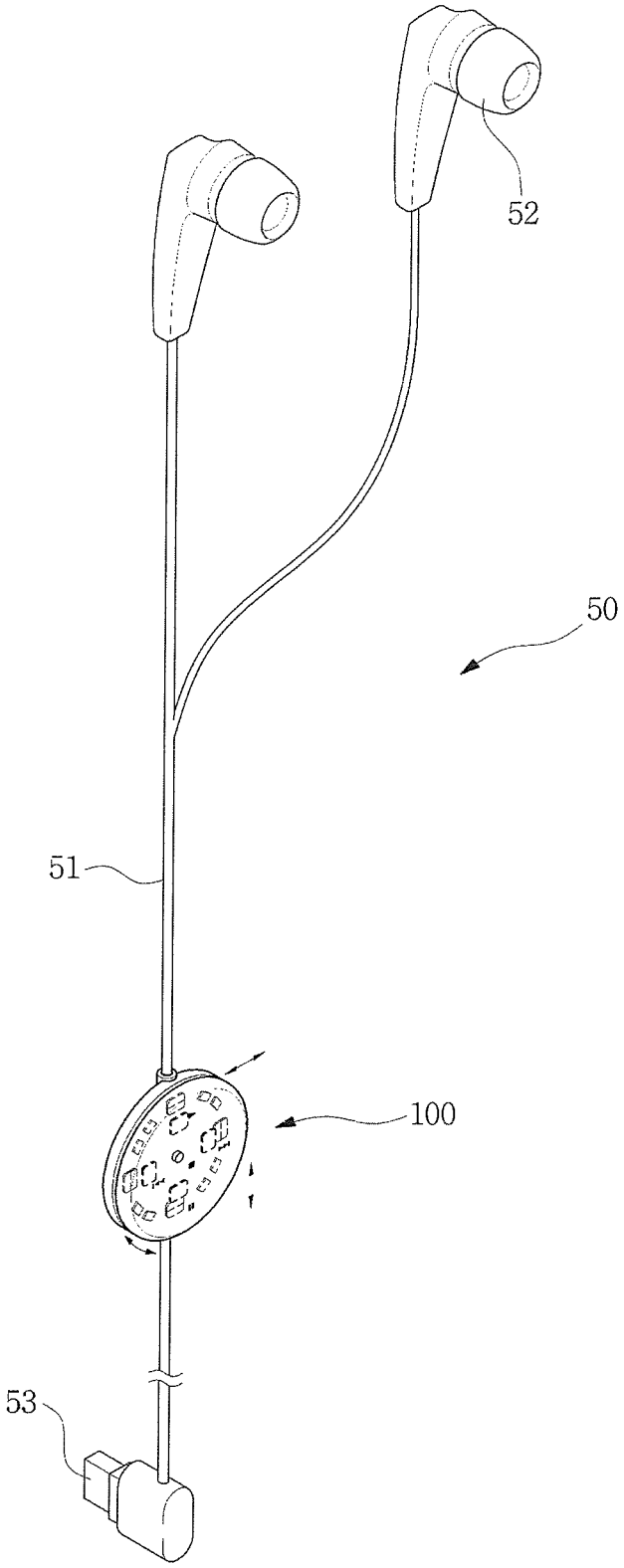
FIG. 2 is a perspective view illustrating an earphone set and a switch assembly thereof according to a first embodiment of the present invention.
Figure 3:
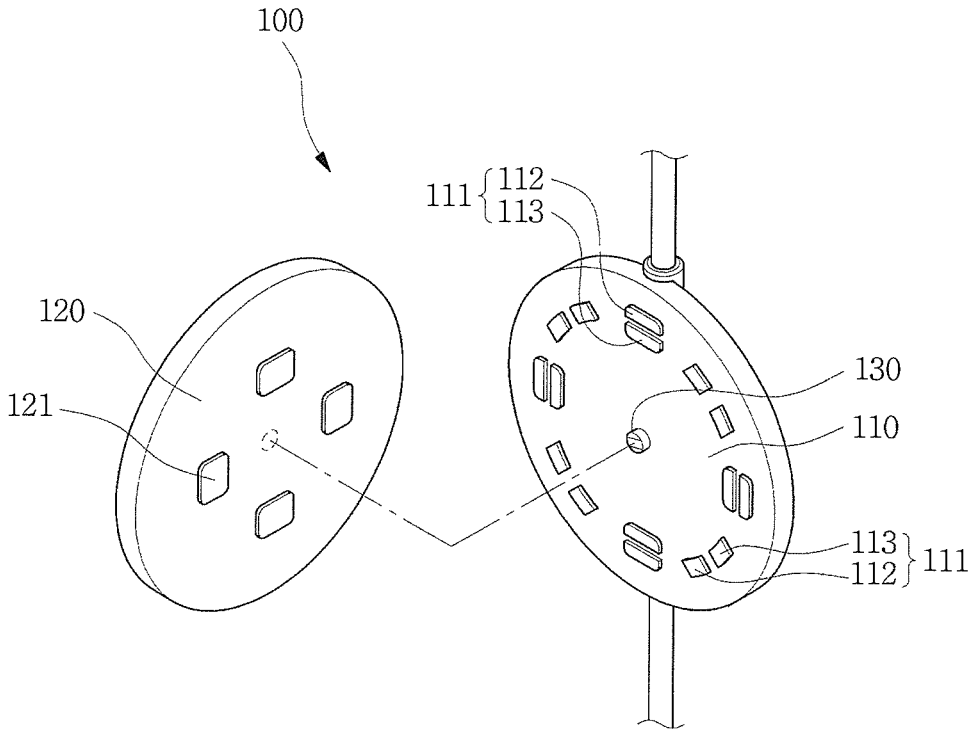
FIG. 3 is an exploded perspective view illustrating a first plate and a second plate in the switch assembly of FIG. 2.
Figure 4A:
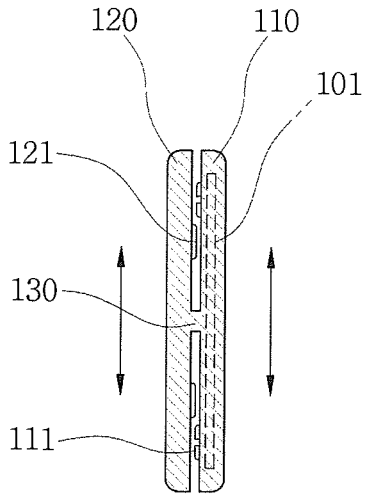
FIG. 4A is a cross-sectional view illustrating the switch assembly before operation.
Figure 4B:
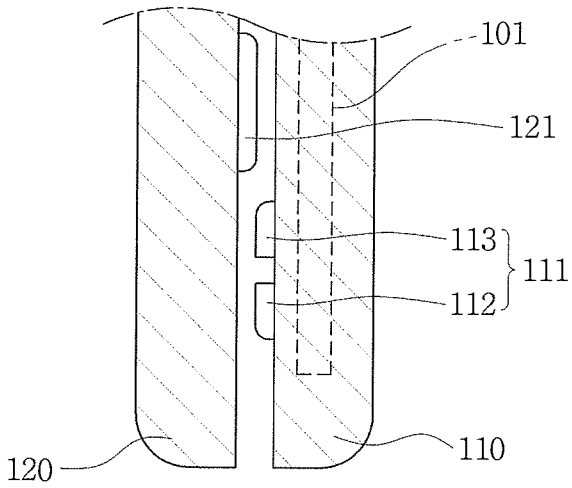
FIG. 4B is a magnified cross-sectional view illustrating the switch assembly before operation.
Figure 5A:
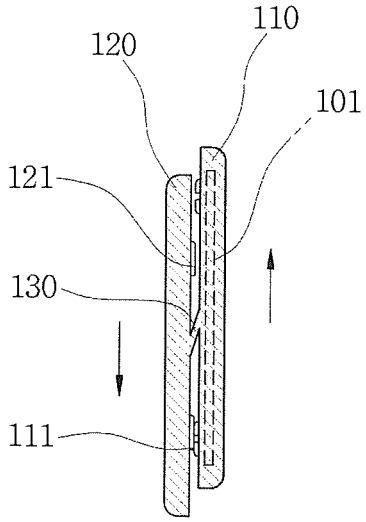
FIG. 5A is a cross-sectional view illustrating the switch assembly during operation.
Figure 5B:
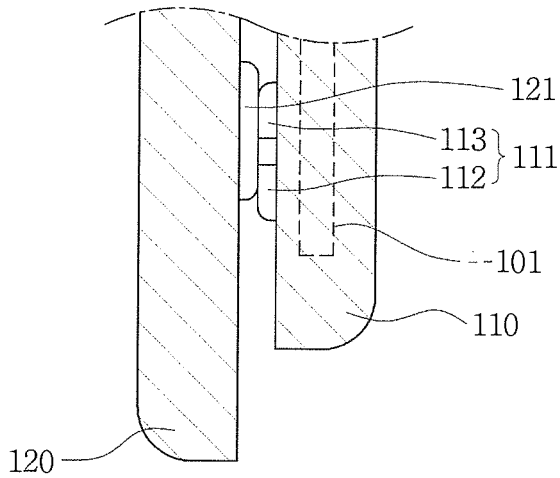
FIG. 5B is a magnified cross-sectional view illustrating the switch assembly during operation.

FIG. 2 is a perspective view illustrating an earphone set and a switch assembly thereof according to a first embodiment of the present invention, FIG. 3 is an exploded perspective view illustrating a first plate and a second plate in the switch assembly of FIG. 2, FIGS. 4A and 4B are a cross-sectional views illustrating the switch assembly of FIG. 2 before operation, and FIGS. 5A and 5B are a cross-sectional views illustrating the switch assembly of FIG. 2 during operation.

Referring to FIGS. 2 to 5B, an earphone set 50 includes speakers 52 at one end of a wire 51 thereof, a connection jack 53 at the other end of the wire 51, and a switch assembly 100 for selecting and regulating operation modes, volume or so forth of an electronic device such as a mobile communication terminal.

The switch assembly 100 includes a first plate 110 in which a board 101 is mounted, and a second plate 120 installed opposite the first plate 110 at a predetermined distance.

In order to selectively connect a circuit of the board 101, the first plate 110 is provided, on a rear face thereof, with a plurality of first contacts 111, and the second plate 120 is provided, on a front face thereof, with a plurality of second contacts 121 corresponding to the first contacts 111. Here, both the first contacts 111 and the second contacts 121 have electrical conductivity. Each of the first contacts 111 is divided into two regions 112 and 113, and each of the corresponding second contacts 121 has a single region.

Thus, before the operation of the switch assembly, the two regions 112 and 113 of the first contact 111 are electrically disconnected from each other. Then, when the second plate 120 slides in a radial or circumferential direction, the second contacts 121 electrically connect the two regions 112 and 113 of the first contact 111, so that electric signals are transmitted.

Although the first and second plates 110 and 120 may be formed into various shapes, it is preferable to be a circular, planar shape from an aesthetic viewpoint. That is, in the case that the first and second plates 110 and 120 are formed into a circular, planar shape, the switch assembly 100 looks neat in appearance, and it is easy for a user to slide and/or rotate the first plate 110 in a radial and/or circumferential direction.

A connection member 130 is provided between the first and second plate 110 and 120 to thereby resiliently connect the plates to one other.

It is preferable that the connection member 130 is made of a flexible, resilient material such as rubber in the aspect of operation. The connection member 130 is positioned at the center of the first and second plates 110 and 120.

Now description will be made in detail of the operations of the earphone set and the switch assembly thereof.

First, a user puts the jack 53 of the earphone set 50 into a connector of a mobile communication terminal, which is not illustrated in the figure, and then fits speakers 52 into his/her ears (not shown). Then, the user operates the switch assembly 100 for regulating the operation mode and volume.

In operating the switch assembly, in the state where the user fixedly supports the first plate 110 with his/her forefinger, the user slides the second plate 120 with respect to the connection member 130 in a radial or circumferential direction while touching it softly. Then, the first contacts 111 are brought into contact with the second contacts 121, so that the two regions 112 and 113 of the first contacts 111 are electrically connected to each other, thereby transmitting electric signals to the board 101. As a result, the user can regulate the operation mode or volume.

Since the connection member 130 is made of a resilient material, it returns to its original position when the user separates his/her finger from the second plate 120 which has been pressed.

Figure 6:
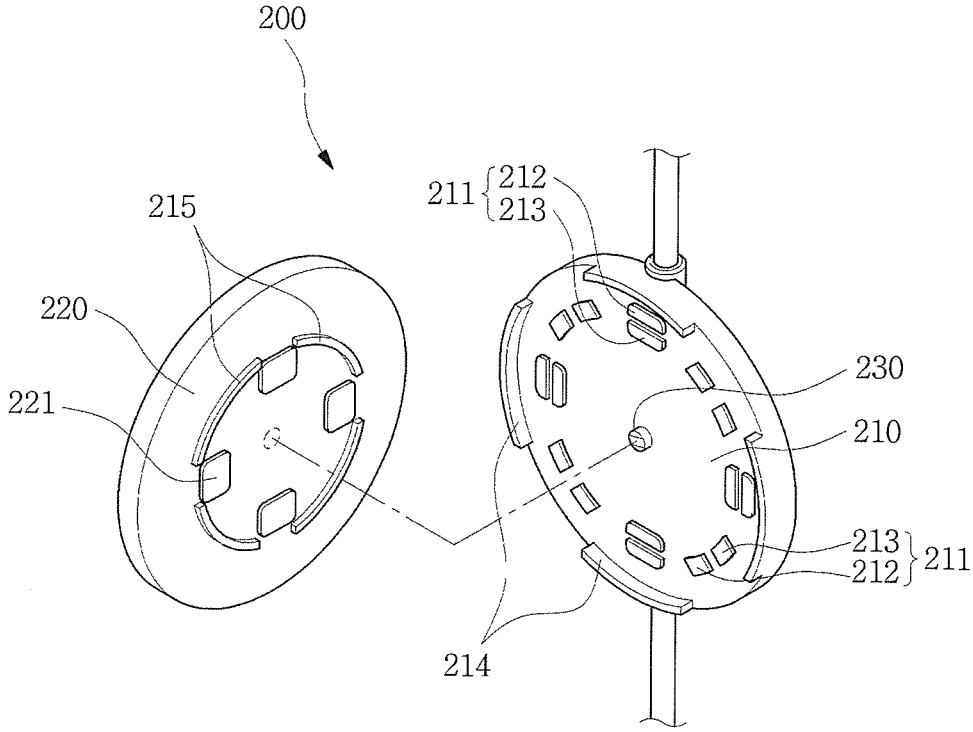
FIG. 6 is an exploded perspective view illustrating a switch assembly according to a second embodiment of the invention.
Figure 7A:
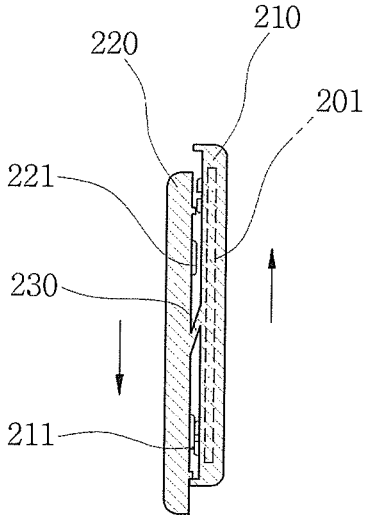
FIG. 7A is a cross-sectional view illustrating the switch assembly of FIG. 6.
Figure 7B:
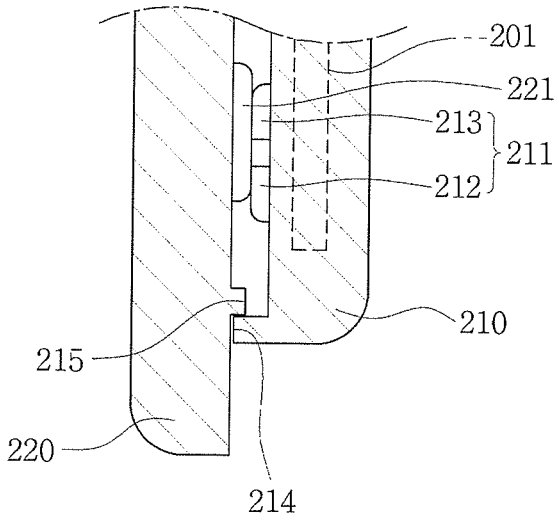
FIG. 7B is a magnified cross-sectional view illustrating the switch assembly of FIG. 6.

FIG. 6 is an exploded perspective view illustrating a switch assembly according to a second embodiment of the invention, and FIGS. 7A and 7B are a cross-sectional views illustrating the switch assembly of FIG. 6.

Referring to FIGS. 6, 7A and 7B, the switch assembly 200 according to the second embodiment of the invention includes a first plate 210 in which a board 201 is mounted, and a second plate 220 installed opposite the first plate 210 at a predetermined distance.

In order to selectively connect a circuit of the board 201, the first plate 210 is provided, on a rear face thereof, with a plurality of first contacts 211, and the second plate 220 is provided, on a front face thereof, with a plurality of second contacts 221 corresponding to the first contacts 211. Here, both the first contacts 211 and the second contacts 221 have electrical conductivity. An area of the first contacts 211 is divided into two regions 212 and 213, and that of the corresponding second contacts 221 has a single region.

Thus, before the operation of the switch assembly, the two regions 212 and 213 of the first contacts 211 are electrically disconnected from each other. Then, when the second plate 220 slides in a radial or circumferential direction, the second contacts 221 electrically connects the two regions 212 and 213 of the first contacts 211, so that electric signals are transmitted.

The switch assembly 200 according to the second embodiment of the invention is characterized in that the first plate 210 is provided with circumferential restricting configurations 214 on the rear face thereof, and the second plate 220 is provided with engaging protrusions 215 corresponding to the restricting configurations 214 on the front face thereof.

The restricting configurations 214 and the engaging protrusions 215 serve to restrict a movement range of the first plate 210 so as to prevent the connection member 230 from being broken or cut when the second plate 220 slides on the first plate 210 in radial and circumferential directions with respect to the connection member 230.

Figure 8:
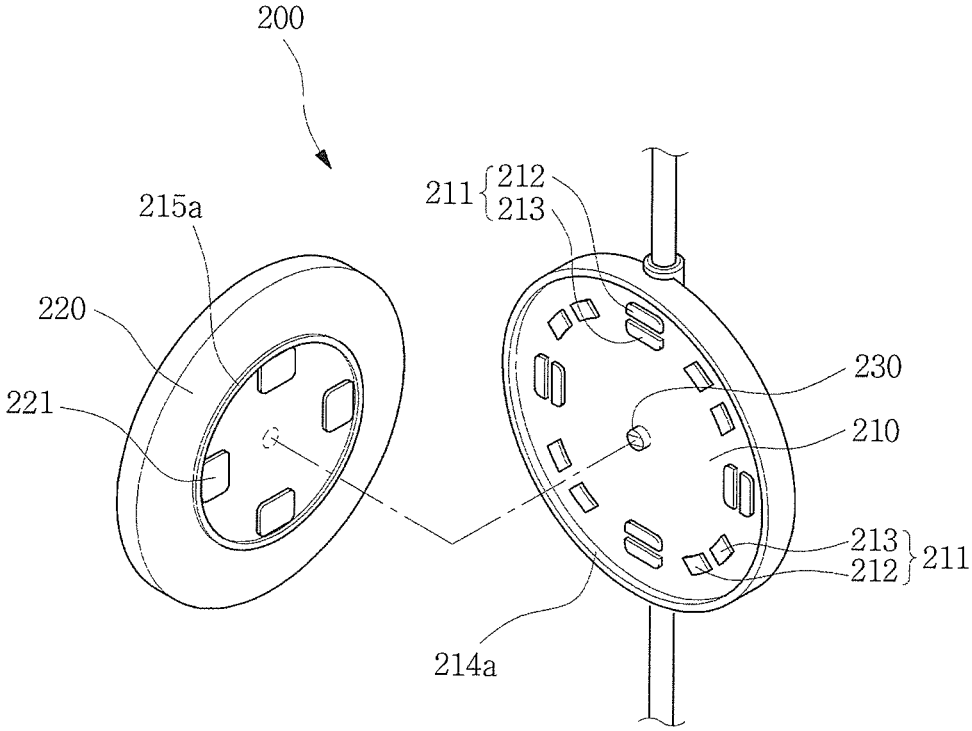
FIG. 8 is an exploded perspective view illustrating a modified example of the switch assembly of FIG. 6.
Figure 9:
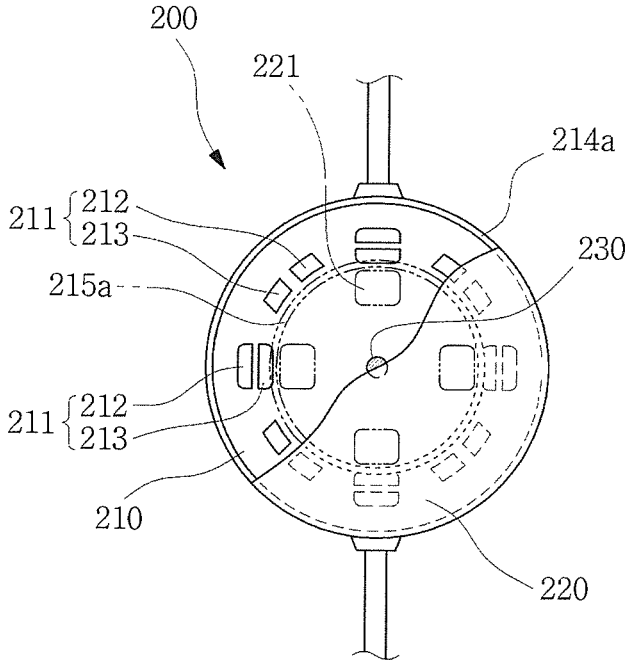
FIG. 9 is a front view of FIG. 8.

FIG. 8 is an exploded perspective view illustrating a modified example of the switch assembly according to the second embodiment of the invention, and FIG. 9 is a front view of FIG. 8.

Referring to FIGS. 8 and 9, the first plate 210 is provided with a circular circumferential restricting configuration 214*a* on the rear face thereof and the second plate 220 is provided with a circular engaging protrusion 215*a* corresponding to the configuration 214*a* on the front face thereof. In the figures, parts other than the circular restricting configuration 214*a* and the circular engaging protrusion 215*a* are identical to those of the switch assembly shown in FIGS. 6 and 7, and so a detailed description thereof will be omitted.

Figure 10:
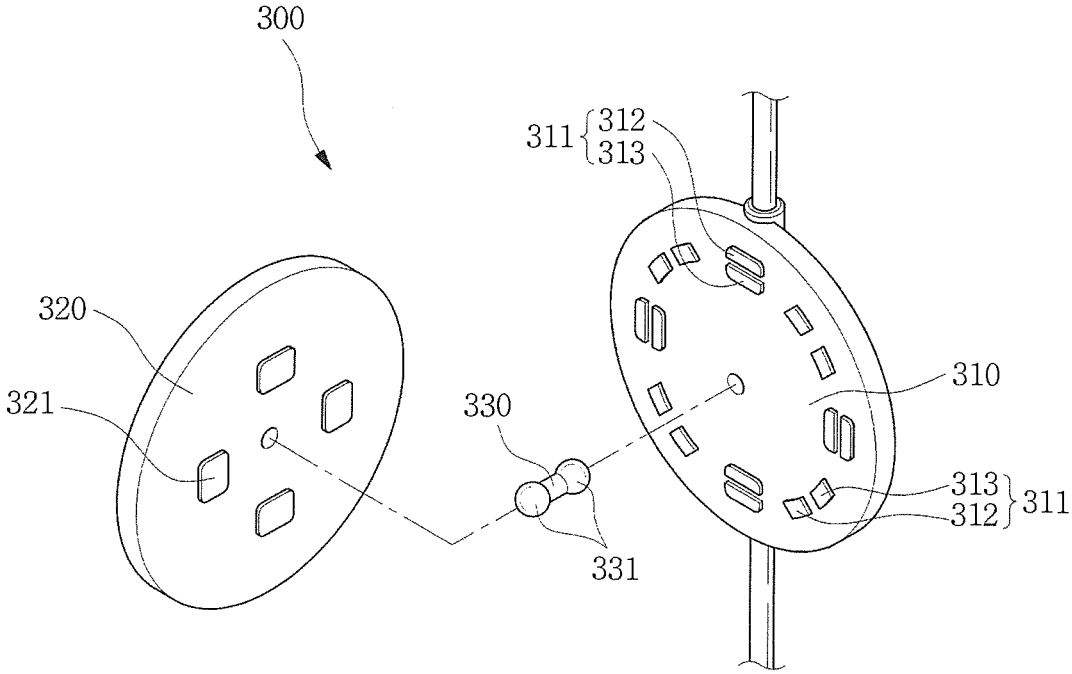
FIG. 10 is an exploded perspective view illustrating a switch assembly according to a third embodiment of the invention.
Figure 11A:
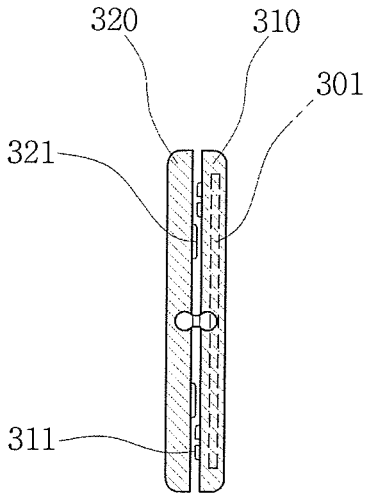
FIG. 11A is a cross-sectional view illustrating the switch assembly of FIG. 10.
Figure 11B:
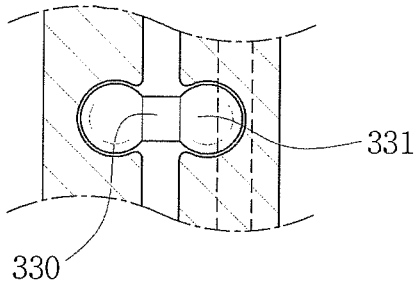
FIG. 11B is a magnified cross-sectional view illustrating the switch assembly of FIG. 10.

FIG. 10 is an exploded perspective view illustrating a switch assembly according to a third embodiment of the invention, and FIGS. 11A and 11B are a cross-sectional views illustrating the switch assembly of FIG. 10.

Referring to FIGS. 10, 11A and 11B, the switch assembly 300 according to the third embodiment of the invention includes a first plate 310 in which a board 301 is mounted, and a second plate 320 installed opposite the first plate 310 at a predetermined distance.

In order to selectively connect a circuit of the board 301, the first plate 310 is provided with a plurality of first contacts 311, on a rear face thereof, and the second plate 320 is provided with a plurality of second contacts 321 corresponding to the first contacts 311, on a front face thereof. Here, both the first contacts 311 and the second contacts 321 have electrical conductivity. An area of the first contacts 311 is divided into two regions 312 and 313, and that of the corresponding second contacts 321 has a single region.

Thus, before the operation of the switch assembly, the two regions 312 and 313 of the first contacts 311 are electrically disconnected from each other. Then, when the second plate 320 slides in a radial or circumferential direction, the second contacts 321 electrically connect the two regions 312 and 313 of the first contacts 311, so that electric signals are transmitted.

The switch assembly 300 according to the third embodiment of the invention is characterized in that the opposite ends of the connection member 330 are configured of ball joint parts 331, so that, since the connection member 330 can be rotated by the ball joint parts 331 when the second plate 320 slides on the first plate 310 in radial and circumferential directions with respect to the connection member 330, the first plate 310 can more smoothly slide.

Figure 12:
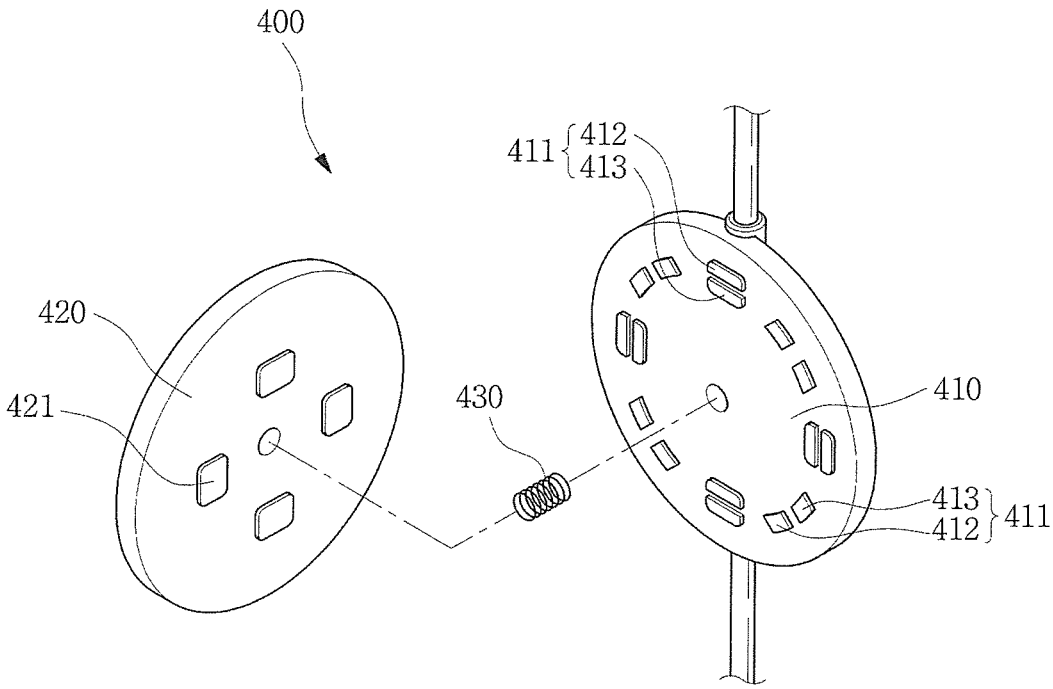
FIG. 12 is an exploded perspective view illustrating a switch assembly according to a fourth embodiment of the invention.
Figure 13A:
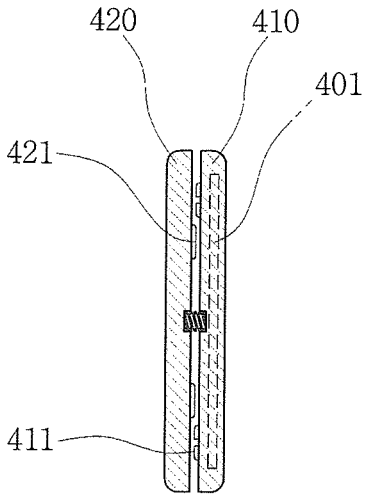
FIG. 13A is a cross-sectional views illustrating the switch assembly of FIG. 12.
Figure 13B:
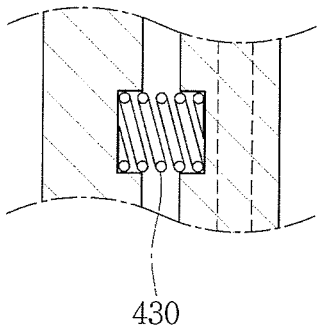
FIG. 13B is a magnified cross-sectional view illustrating the switch assembly of FIG. 12.

FIG. 12 is an exploded perspective view illustrating a switch assembly according to a fourth embodiment of the invention, and FIGS. 13A and 13B are a cross-sectional view illustrating the switch assembly of FIG. 12.

Referring to FIGS. 12, 13A and 13B, the switch assembly 400 according to the fourth embodiment of the invention includes a first plate 410 in which a board 401 is mounted, and a second plate 420 installed opposite the first plate 410 at a predetermined distance.

In order to selectively connect a circuit of the board, the first plate 410 is provided with a plurality of first contacts 411 on a rear face thereof, and the second plate 420 is provided with a plurality of second contacts 421 corresponding to the first contacts 411 on a front face thereof. Here, both the first contacts 411 and the second contacts 421 have electrical conductivity. An area of the first contacts 411 is divided into two regions 412 and 413, and that of the corresponding second contacts 421 has a single region.

Thus, before the operation of the switch assembly, the two regions 412 and 413 of the first contacts 411 are electrically disconnected from each other. Then, when the second plate 420 slides in a radial or circumferential direction, the second contacts 421 electrically connect the two regions 412 and 413 of the first contacts 411, so that electric signals are transmitted.

The switch assembly 400 according to the fourth embodiment of the invention is characterized in that the connection member 430 is configured of a spring, so that, when the second plate 420 slides on the first plate 410 in radial and circumferential directions with respect to the connection member 430, the first plate 410 can more smoothly slide.

Figure 14:
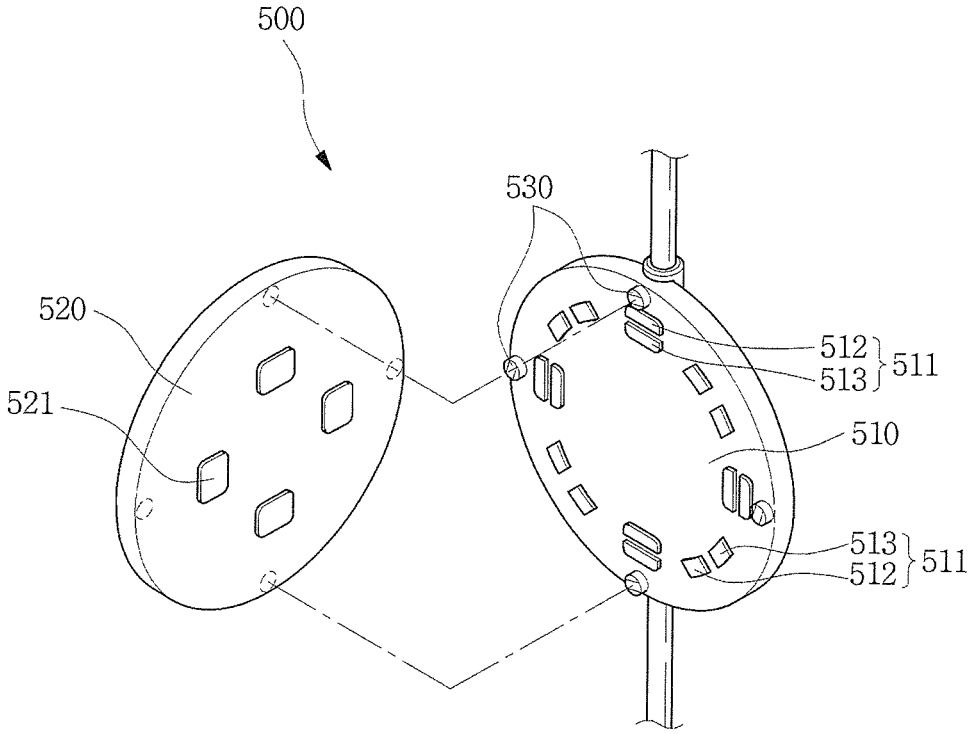
FIG. 14 is an exploded perspective view illustrating a switch assembly according to a fifth embodiment of the invention.
Figure 15A:
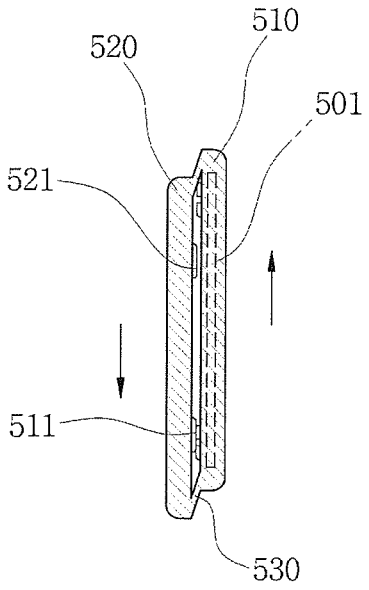
FIG. 15A is a cross-sectional view illustrating the switch assembly of FIG. 14.
Figure 15B:
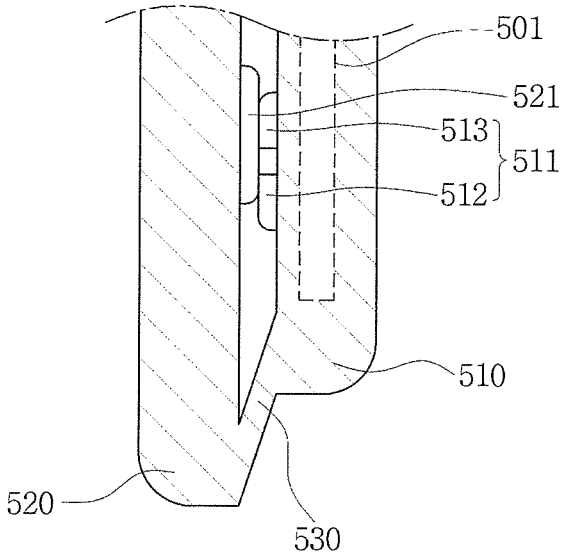
FIG. 15B is a magnified cross-sectional view illustrating the switch assembly of FIG. 14.

FIG. 14 is an exploded perspective view illustrating a switch assembly according to a fifth embodiment of the invention, and FIGS. 15A and 15B are a cross-sectional views illustrating the switch assembly of FIG. 14.

Referring to FIGS. 14, 15A and 15B, the switch assembly 500 according to the fifth embodiment of the invention includes a first plate 510 in which a board 501 is mounted, and a second plate 520 installed opposite the first plate 510 at a predetermined distance.

In order to selectively connect a circuit of the board, the first plate 510 is provided with a plurality of first contacts 511 on a rear face thereof, and the second plate 520 is provided with a plurality of second contacts 521 corresponding to the first contacts 511 on a front face thereof. Here, the first contacts 511 and the second contacts 521 both are electrically conductive. An area of the first contacts 511 is divided into two regions 512 and 513, and that of the corresponding second contacts 521 has a single region.

Thus, before the operation of the switch assembly, the two regions 512 and 513 of the first contacts 511 are electrically disconnected from each other. Then, when the second plate 520 slides in a radial or circumferential direction, the second contacts 521 electrically connect the two regions 512 and 513 of the first contact 511, so that electric signals are transmitted.

The switch assembly 500 according to the fifth embodiment of the invention is characterized in that connection members 530 are disposed along the outer circumference of the second plate 520, so that when the second plate 520 slides on the first plate 510 in radial and circumferential directions with respect to the connection member 530, the first plate 510 can more smoothly slide without being detached from the second plate although it has the restricting configurations and the engaging protrusions shown in FIGS. 7A and 7B.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A switch assembly for an earphone set, comprising:

a first plate in which a board is mounted;

a second plate installed opposite the first plate so as to be slidable in radial and circumferential directions;

a connection member provided between the first and second plates so as to connect the first and second plates;

a plurality of first contacts installed on a rear face of the first plate; and a plurality of second contacts installed on a front face of the second plate corresponding to the first contacts.

2. The switch assembly according to claim 1, wherein the first and second plates are of a circular, planar shape.

3. The switch assembly according to claim 1, wherein the first plate includes at least one restricting configuration on the rear face thereof in a circumferential direction, and the second plate includes at least one engaging protrusion corresponding to the restricting configuration on the front face thereof.

4. The switch assembly according to claim 1, wherein the connection member is disposed at the center of the first and second plates.

5. The switch assembly according to claim 4, wherein the connection member is made of rubber.

6. The switch assembly according to claim 1, wherein the connection member includes a spring.

7. The switch assembly according to claim 1, wherein the connection member includes ball joint parts at opposite ends thereof.

8. The switch assembly according to claim 1, wherein the connection member is disposed along outer circumferences of the first and second plates.

9. An earphone set comprising:

speakers provided at one end of a wire;

a connection jack provided at the other end of the wire; and a switch assembly having a first plate with a plurality of first contacts and a second plate with a plurality of second contacts, the first plate installed between both ends of the wire, the second plate being installed opposite the first plate by means of a connection member so as to be slidable in radial and circumferential directions with respect to the connection member.

10. The earphone set according to claim 9, wherein the first contacts come into contact with the second contacts when the first plate slides in radial and circumferential directions.

11. The earphone set according to claim 9, wherein the first plate includes at least one restricting configuration on a rear face thereof in a circumferential direction, and the second plate includes at least one engaging protrusion corresponding to the restricting configuration on a front face thereof.

12. The earphone set according to claim 9, wherein the connection member is disposed at the center of the first and second plates.

13. The earphone set according to claim 9, wherein the connection member includes ball joint parts at opposite ends thereof.

14. A switch assembly for an earphone set, comprising:

a first plate in which a board is mounted;

a second plate installed opposite the first plate so as to be slidable in radial and circumferential directions;

a connection member provided between the first and second plates so as to resiliently connect the first and second plates;

a plurality of first contacts installed on a rear face of the first plate, each of the first contacts comprising a first region and a second region electrically disconnected from one another; and a plurality of second contacts installed on a front face of the second plate corresponding to the first contacts, wherein when one of the plurality of second contacts comes into contact with one of the plurality of first contacts, the second contact electrically connects the first and second regions.

15. The switch assembly according to claim 14, wherein the first and second plates are of a circular, planar shape.

16. The switch assembly according to claim 14, wherein the first plate includes at least one restricting configuration on the rear face thereof in a circumferential direction, and the second plate includes at least one engaging protrusion corresponding to the restricting configuration on the front face thereof.

17. The switch assembly according to claim 14, wherein the connection member is disposed at the center of the first and second plates.

18. The switch assembly according to claim 14, wherein the connection member is selected from the group consisting of a rubber material, a spring, and a ball joint part.

* * * * *